US007325533B2

(12) United States Patent
Matsuda

(10) Patent No.: US 7,325,533 B2
(45) Date of Patent: Feb. 5, 2008

(54) LEISURE VEHICLE WITH AN ELECTRONIC THROTTLE CONTROL SYSTEM

(75) Inventor: Yoshimoto Matsuda, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/606,402

(22) Filed: Nov. 28, 2006

(65) Prior Publication Data

US 2007/0119419 A1 May 31, 2007

(30) Foreign Application Priority Data

Nov. 28, 2005 (JP) ..... 2005-341716

(51) Int. Cl.
*F02D 9/02* (2006.01)
*F02D 41/14* (2006.01)

(52) U.S. Cl. ..... 123/399; 123/361

(58) Field of Classification Search ..... 123/350–356, 123/361, 396, 399
See application file for complete search history.

(56) References Cited

U.S. PATENT DOCUMENTS 5,615,654 A * 4/1997 Weisman et al. ..... 123/350
6,488,006 B2 * 12/2002 Pursifull ..... 123/399
6,816,776 B2 * 11/2004 Yasui et al. ..... 123/399

FOREIGN PATENT DOCUMENTS

JP 04-183644 6/1992

* cited by examiner

*Primary Examiner*—T. M Argenbright
(74) *Attorney, Agent, or Firm*—Alleman Hall McCoy Russell & Tuttle LLP

(57) ABSTRACT

A leisure vehicle comprising an electronic control throttle system of an engine in which an actuator drives a throttle valve in response to an operation signal according to an operation amount of a throttle operation device, the electronic control throttle system including a throttle valve controller configured to send a control signal to the actuator to drive the throttle valve. The throttle valve controller is configured to give a gain to compensate for a deviation between a target opening degree of the throttle valve that is set based on the operation amount of the throttle operation device and an actual opening degree of the throttle valve which is a detected opening degree of the throttle valve. The throttle valve controller is configured to set the gain that causes the throttle valve to enter an overshooting region that exceeds a fully open position in a movement range of the throttle valve.

5 Claims, 6 Drawing Sheets

LEISURE VEHICLE WITH AN ELECTRONIC THROTTLE CONTROL SYSTEM

TECHNICAL FIELD

The present invention generally relates to leisure vehicles. More particularly, the present invention relates to leisure vehicles such as a two-wheeled motor vehicle, a three-wheeled motor vehicle, an all terrain vehicle (ATV), personal watercraft, etc., which are equipped with an electronic control throttle system configured to electronically control a throttle valve in the interior of a throttle body that is disposed in an air-intake passage of an engine.

BACKGROUND ART

A throttle valve is disposed in an air-intake passage coupled to an engine mounted in a two-wheeled motor vehicle, etc., and is configured to control the amount of air supplied to the engine. A rider manually operates a throttle operation device such as an accelerator pedal, an accelerator grip (throttle grip), or a throttle lever to move the throttle valve.

An electronic control throttle system is typically configured in such a manner that the throttle valve is controlled by a so-called drive-by-wire system. To be specific, upon the rider operating the throttle operation device, a position sensor attached to the throttle operation device detects the operation amount of the throttle operation device, and sends a detection signal to a controller, for example, an electronic control unit (ECU). Receiving the detection signal, the ECU determines a target opening degree of the throttle valve, and sends a signal indicating the target opening degree to a throttle valve computer (TVC). Based on the target opening degree signal, the TVC causes a drive unit, for example, an actuator such as a DC motor, to actuate the throttle valve.

A throttle position sensor attached to the throttle valve detects an actual opening degree of the throttle valve, and sends a detection signal to the TVC. The TVC sends a control signal to the actuator in order to compensate for a deviation between the target opening degree and the actual opening degree. In this manner, the throttle valve is moved to the opening degree so as to precisely respond to the operation of the throttle operation device, thus controlling the amount of air to be supplied to the engine.

Typically, in such throttle valve control, occurrence of overshooting in which the throttle valve is moved to an opening degree that is beyond its target opening degree (e.g., fully open position) is inhibited. If the overshooting occurs, the actual throttle opening degree undesirably fluctuates, so that an engine speed fluctuates according to the fluctuation of the amount of air. To inhibit this, control is executed to inhibit the occurrence of the overshooting. Such a technique is disclosed in, for example, Japanese Laid-Open Patent Application Publication No. Hei. 4-183644.

In order to inhibit the occurrence of the overshooting in PID control, PD control, etc., a proportional gain is typically set smaller. By setting a derivative gain larger, a convergence property of the throttle valve in a fully open position is improved. Concurrently with or in addition to this, a mechanical stopper may be mounted at the fully open position of the throttle valve to set a mechanical fully open position.

However, in the throttle valve control that is directed to improving the convergence property in the fully open position, responsiveness of the throttle valve opening degree to quick operation of the throttle operation device is low. Even if the throttle operation device is quickly operated to quickly move the throttle valve to the fully open position to thereby rapidly increase an engine speed, the throttle valve is actually not moved at a desired speed. In the case where the mechanical stopper defines the fully open position of the throttle valve, a problem that an impact is applied to a motor of the actuator, a gear system, the mechanical stopper, and so on, may arise. In a substantially fully open position of the throttle valve, the amount of air does not substantially fluctuate regardless of the fluctuation in the opening degree of the throttle valve.

SUMMARY OF THE INVENTION

The present invention addresses the above described conditions, and an object of the present invention is to provide a leisure vehicle equipped with an electronic control throttle system capable of improving responsiveness of a throttle valve opening degree of the engine to an operation of a throttle operation device of the vehicle.

According to the present invention, there is provided a leisure vehicle comprising an electronic control throttle system of an engine in which an actuator drives a throttle valve of the engine in response to an operation signal according to an operation amount of a throttle operation device of the vehicle, the electronic control throttle system including a throttle valve controller configured to send a control signal to the actuator to drive the throttle valve, wherein the throttle valve controller is configured to give a gain to compensate for a deviation between a target opening degree of the throttle valve that is set based on the operation amount of the throttle operation device and an actual opening degree of the throttle valve which is a detected opening degree of the throttle valve, and wherein the throttle valve controller is configured to set the gain that causes the throttle valve to enter an overshooting region that exceeds a fully open position in a movement range of the throttle valve.

By thus positively setting the overshooting region for the opening operation of the throttle valve, a large gain to compensate for the deviation associated with feedback control is given. As a result, responsiveness of the opening operation of the throttle valve to the operation of the throttle operation device is improved.

The throttle valve may be a butterfly valve including a rotatable valve shaft and a valve disc attached to the rotatable valve shaft. A projected image of the valve disc at an upper limit of the overshooting region that is formed as viewed from a center axis direction of an air flow passage of the throttle valve may fall within a projected image of the valve shaft that is formed as viewed from the center axis direction.

Since the flow passage cross-sectional area of air taken in from outside and supplied to the engine does not substantially change even when the tip end of the valve disc is displaced within the range of the projected image of the valve shaft in the opening and closing directions, the fluctuation in the amount of air due to the occurrence of the overshooting can be avoided.

The throttle valve may be a butterfly valve, and the upper limit of the overshooting region of the throttle valve may be set in a position obtained by rotating the throttle valve from the fully open position to a position that is open to an 8% to 12% opening degree of the fully open position.

When the overshooting occurs within the above range, the fluctuation in the amount of air taken in in the vicinity of the fully open position of the throttle valve is small. Therefore, traveling capability or output of the leisure vehicle equipped with such an engine is not substantially affected by the overshooting when the throttle valve is moved to the fully open position.

The electronic control throttle system may further include a mechanical stopper that is disposed at a location of the movement range of the throttle valve to inhibit the throttle valve from being moved in an opening direction beyond the upper limit of the overshooting region. With such a configuration, it is possible to inhibit the throttle valve from being moved to an opening degree that exceeds the upper limit of the overshooting region.

The above described electronic control throttle system may be configured to set gains which are made different between a slight opening degree range of the throttle valve and an opening degree range of the throttle valve that is larger than the slight opening degree range.

The above and further objects and features of the invention will more fully be apparent from the following detailed description with accompanying drawings.

DETAILED DESCRIPTION OF THE PREFERRED EMBODIMENTS

Figure 1:
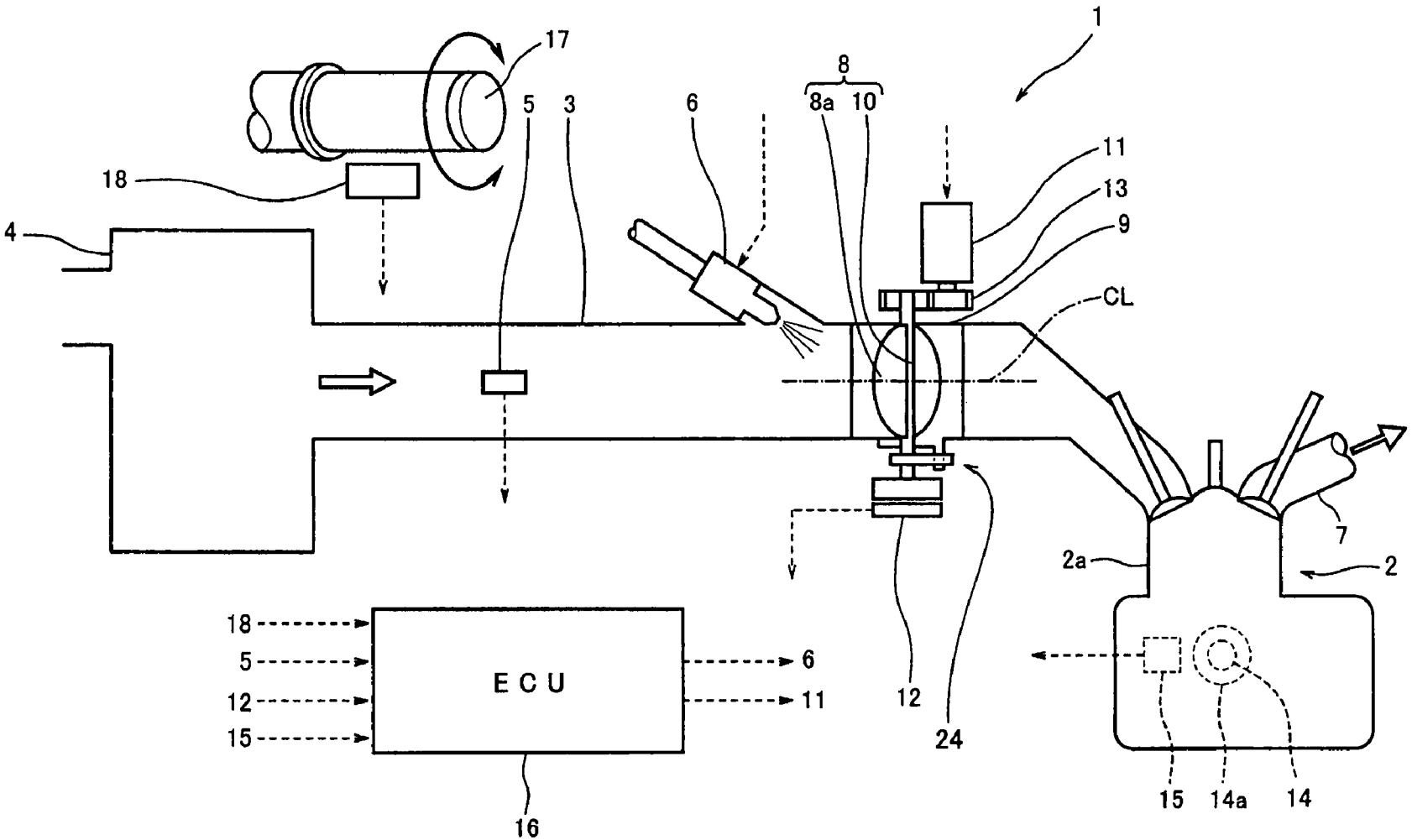
FIG. 1 is a conceptual view showing an air-intake passage of an engine equipped with an electronic control throttle system and associated components which are mounted in a leisure vehicle according to an embodiment of the present invention.

Hereinafter, an electronic control throttle system equipped in a leisure vehicle according to an embodiment of the present invention will be described with reference to the accompanying drawings. FIG. 1 is a conceptual view showing an air-intake passage 3 coupled to an engine 2 equipped with an electronic control throttle system 1.

Turning now to FIG. 1, an air cleaner 4 is disposed upstream of the air-intake passage 3 of the engine 2, and a flow meter 5 for measuring the amount of air (or air-intake pressure sensor) 5 is disposed downstream of the air cleaner 4. The electronic control throttle system 1 is disposed downstream of the flow meter 5 and is configured to control the amount of air taken in from outside and supplied to the engine 2. A fuel injector 6 is attached to the air-intake passage 3 adjacent the electronic control throttle system 1. An exhaust gas passage 7 is formed on a cylinder head 2*a* of the engine 2 to exhaust a combustion exhaust gas.

The electronic control throttle system 1 includes a throttle body 9 within which a throttle valve 8 of a butterfly valve type is mounted to be rotatable within a predetermined angle range. The throttle valve 8 includes a circular-plate shaped valve disc 8*a* and a valve shaft 10 which is a rotational shaft thereof and is formed to pass through a center region of the valve disc 8*a*. A DC motor 11, which is an actuator configured to rotate the throttle valve 8, is coupled to one end portion of the valve shaft 10 via a gear train 13. A throttle position sensor 12 is attached to an opposite end portion of the valve shaft 10 and is configured to detect an opening degree of the throttle valve 8. A crank angle sensor 15 is attached opposite to a rotor (detected unit) 14*a* mounted to a crankshaft 14 and is configured to detect a rotational angle or phase of the crankshaft 14.

In FIG. 1, a positional relationship between the fuel injector 6 and the throttle body 9 is illustrated as being different from an actual positional relationship, for easier understanding. The actual position of the fuel injector 6 is defined in such a manner that the illustrated position is rotated 90 degrees around a center axis CL of the air-intake passage 3.

An electronic control unit (ECU) 16 controls the operation of the throttle valve 8 and the operation of the fuel injector 8. When the DC motor 11 causes the throttle valve 8 to be moved in an opening direction, the amount of air taken in from outside increases, whereas when the DC motor 11 causes the throttle valve 8 to be moved in a closing direction, the amount of air decreases. In order to inject fuel according to the amount of air, the ECU 16 controls a fuel injection amount of the fuel injector 6 depending on an opening degree or a closing degree of the throttle valve 8. To enable an idling state of the engine 2 with the throttle valve 8 closed, an air passage (not shown) that bypasses the throttle valve 8 is formed or the valve disc 8*a* is configured to be stopped in a position that is slightly open from the fully closed position.

Whereas in this embodiment the fuel injector 6 is attached in close proximity to the throttle body 9, it may alternatively be attached to the cylinder head 2*a* of the engine 2 or the like.

By operating a throttle operation device (accelerator grip in this embodiment) 17, the opening degree of the throttle valve 8 is controlled by the ECU 16. A grip position sensor 18 is attached to the accelerator grip 17 and is configured to detect its operation amount, to be specific, its rotational angle. Based on a position detection signal (operation signal) from the grip position sensor 18, an air amount detection signal from the flow meter 5, a position detection signal (an actual opening degree signal) from the throttle position sensor 12, ambient temperature, ambient pressure, etc., the ECU 16 determines the amount of air to be supplied to the engine 2 and controls an opening and closing operation of the throttle valve 8. In addition, based on a rotational angle detection signal from the crank angle sensor 15, the ECU 16 controls the operation of the fuel injector 6. An ignition signal, other controls, etc., will not be described for the sake of brevity as they are well known in the art.

Figure 2:
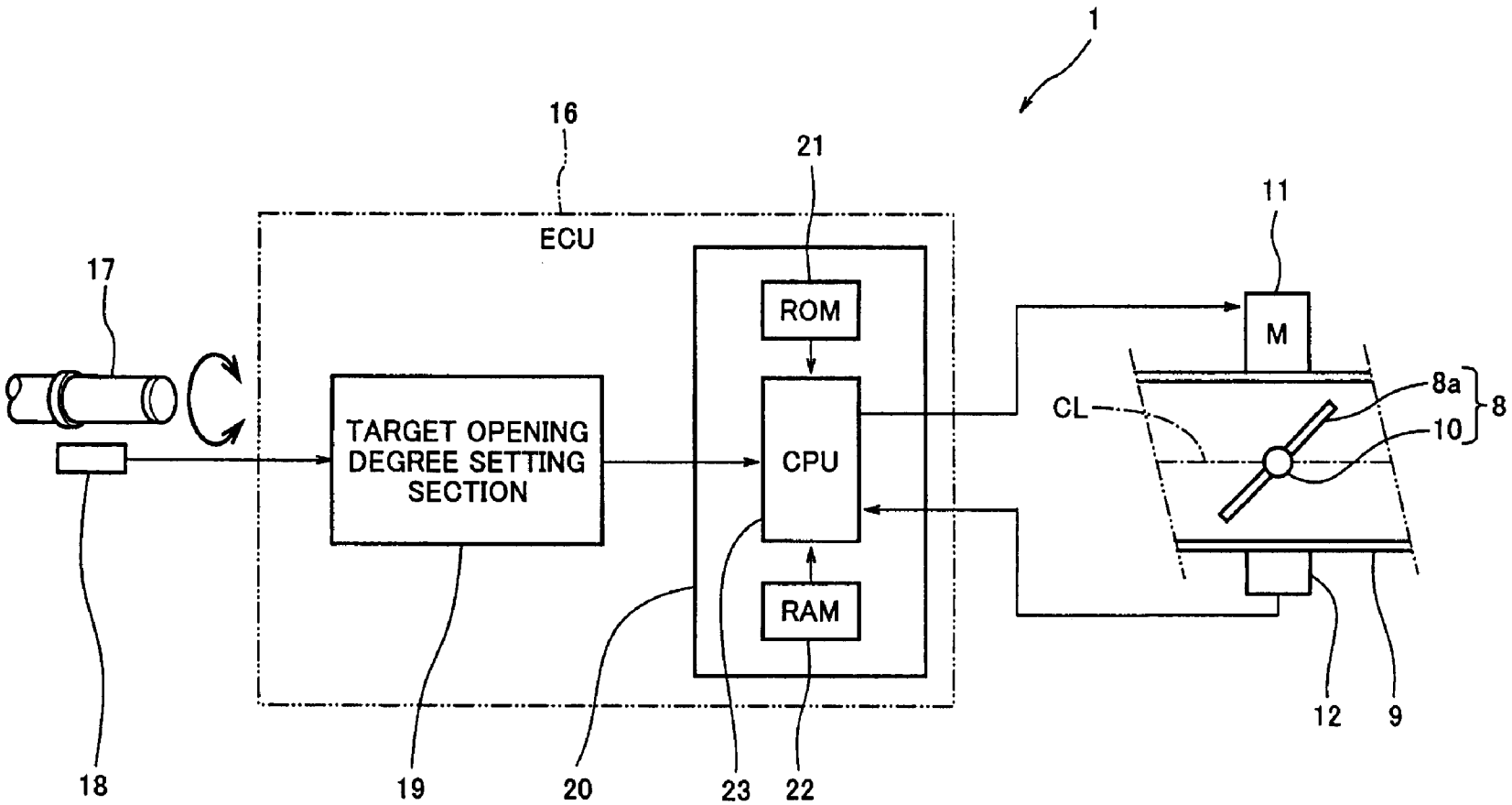
FIG. 2 is a block diagram showing a control configuration of the electronic control throttle system of FIG. 1.

With reference to a control block diagram of FIG. 2, a control process executed in the electronic control throttle system 1 will be described. In this embodiment, the operation of the electronic control throttle system 1 that is executed when the rider has operated the accelerator grip 17 during travel of the motorcycle will be described. The ECU 16 executes a control routine for each very short time period as follows.

i) The throttle position sensor 12 equipped in the electronic control throttle system 1 sends the detection signal indicating the actual opening degree of the throttle valve 8 to a throttle valve computer (TVC) 20. ii) The TVC 20 computes a current opening degree of the throttle valve 8. iii) Upon the rider operating the accelerator grip 17, the grip position sensor 18 detects its operation amount (rotational angle), and sends a detection signal to a target opening degree setting section 19 of the ECU 16. iv) The target opening degree setting section 19 receives the air amount (air-intake pressure) detection signal from the flow meter 5 (FIG. 1), detection signals of the ambient pressure, the ambient temperature, etc., and computes the target opening degree of the throttle valve 8 based on these detection signals. v) The target opening degree setting section 19 sends the target opening degree signal to the TVC 20 of the ECU 16. vi) The TVC 20 compares the target opening degree to the actual opening degree and sends a control signal to the DC motor 11 to compensate for a deviation between them. vii) The DC motor 11 rotates by an angle based on the control signal to move the throttle valve 8.

As should be understood from the above, the throttle valve 8 is feedback-controlled. A ROM 21 of the TVC 20 contains programs, data, and so on, that are utilized to execute computation necessary for the above described control routine. The CPU 23 executes the computation according to the programs while the data, numeric values, etc. are temporarily stored in a RAM 22 of the TVC 20.

In the electronic control throttle system 1, the control signal of the throttle valve 8 is set by multiplying the deviation between the target opening degree and the actual opening degree of the throttle valve 8 by a control coefficient that gives a large gain. To be specific, the TVC 20 sets a large gain to cause the overshooting to occur when the throttle valve 8 is moved to the fully open position in order to improve responsiveness of the throttle valve 8 to the operation of the accelerator grip 17. A slight fluctuation in the output in a high engine speed range of the engine, i.e., substantially fully open valve position may be allowed, and thus the responsiveness of the opening degree of the throttle valve 8 in medium and low engine speed ranges of the engine 2, i.e., medium opening degree region of the throttle valve 8 may be improved. This is because the slight fluctuation in the output in the high engine speed range does not substantially affect traveling capability of the leisure vehicle such as the motorcycle, whereas fluctuation in the output in response to quick operation of the throttle operation device in the medium and low engine speed ranges substantially affects the traveling capability.

Figure 3:
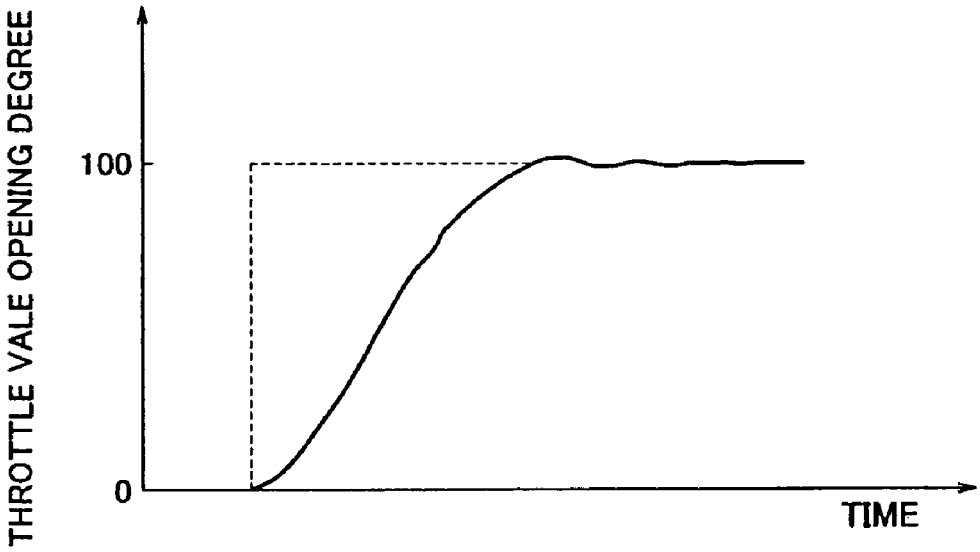
FIG. 3 is a graph showing a throttle valve opening degree which is associated with control for inhibiting the occurrence of overshooting to improve a convergence property of the throttle valve in a fully open position.
Figure 4:
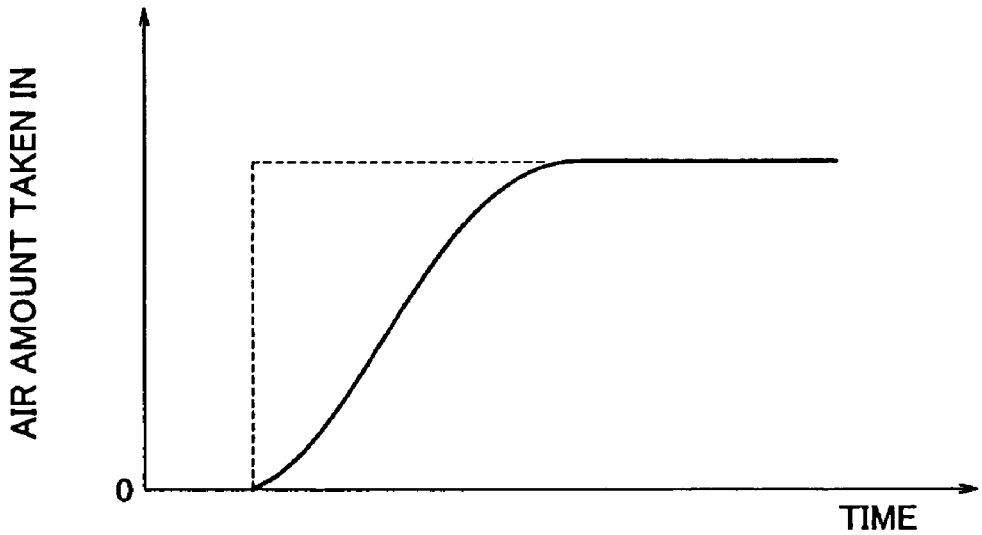
FIG. 4 is a graph showing the amount of air taken in from outside corresponding to the throttle valve opening degree of FIG. 3.
Figure 5:
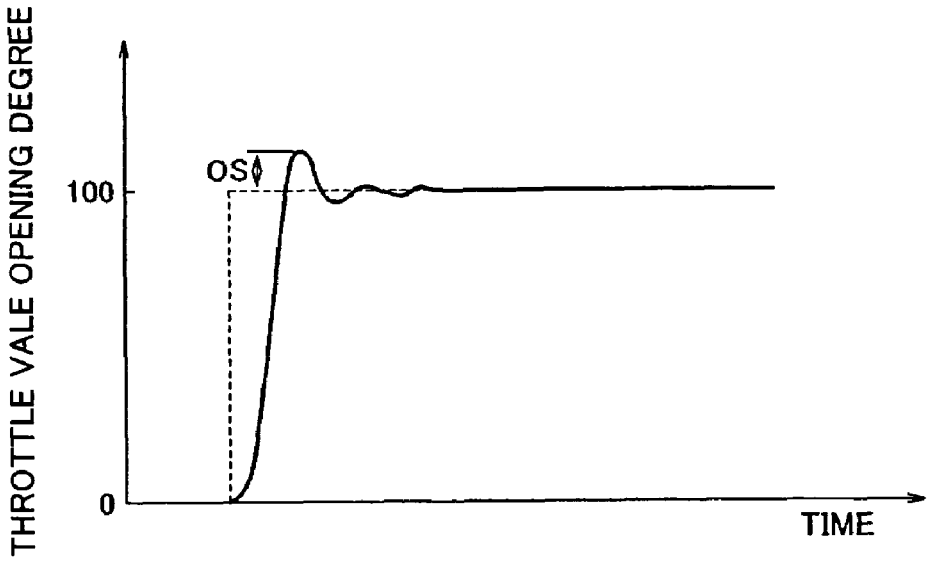
FIG. 5 is a graph showing a throttle valve opening degree which is associated with control for improving responsiveness by overshooting the throttle valve from the fully open position.
Figure 6:
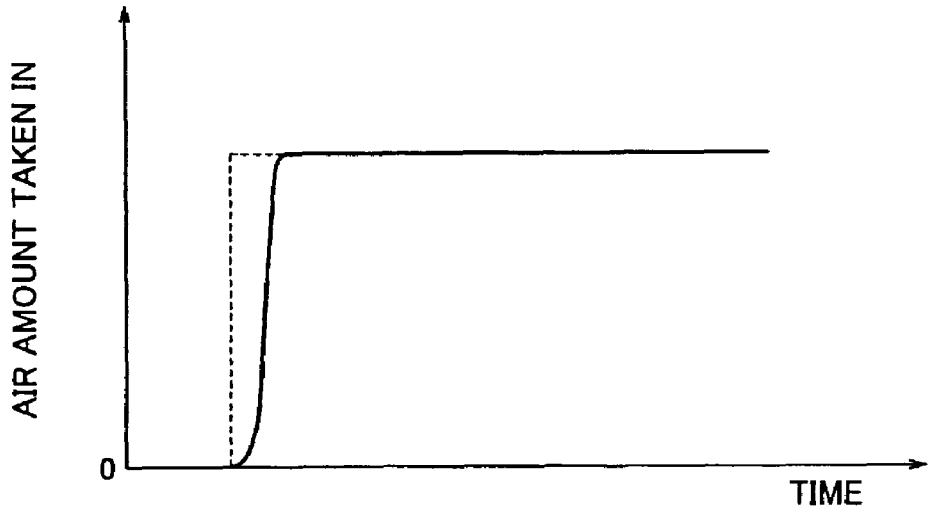
FIG. 6 is a graph showing the amount of air taken in from outside corresponding to the throttle valve opening degree of FIG. 5.

With reference to FIGS. 3 to 6, a relationship between the responsiveness of the throttle valve and the overshooting will be described. FIG. 3 is a graph showing the throttle valve opening degree which is associated with control for inhibiting the occurrence of overshooting to improve convergence property of the throttle valve 8 in the fully open position. FIG. 4 shows the air amount taken in (detected value of the flow meter) corresponding to the throttle valve opening degree of FIG. 3. In FIGS. 3 and 4, a horizontal axis indicates time. FIG. 5 is a graph showing the throttle valve opening degree which is associated with control directed to improving responsiveness of the throttle valve 8 by overshooting (indicated by OS) the throttle valve 8 from the fully open position. FIG. 6 shows the air amount taken in corresponding to the valve opening degree of FIG. 5. In FIGS. 5 and 6, a horizontal axis indicates time.

As indicated by FIGS. 3 and 4, even when the accelerator grip 17 is operated so that the throttle valve 8 is moved in a step shape to the fully open position (indicated by a broken line of FIG. 3), the throttle valve 8 is moved relatively slowly to be opened as indicated by a solid line of FIG. 3, because the gain is set smaller. The throttle valve 8 converges in the fully open position without overshooting or great fluctuation. As shown in FIG. 4, according to the movement of the throttle valve 8 as shown in FIG. 3, the amount of air reaches a target amount relatively slowly without excess or fluctuation. In FIG. 4, an expected value of the air amount increasing in a step shape is indicated by a broken line of FIG. 4.

In contrast, as shown in FIGS. 5 and 6, when the throttle operation device such as the accelerator grip 17 is operated so that the throttle valve 8 is moved to the fully open position (indicated by a broken line of FIG. 5) in a step shape, the throttle valve 8 is moved to be opened in a substantially step shape as indicated by a solid line of FIG. 5, because the gain is set larger. This means that the throttle valve 8 precisely responds to the operation of the throttle operation device. However, the throttle valve 8 overshoots from the fully open position. Nonetheless, as can be seen from FIG. 6, the air amount does not substantially fluctuate regardless of the occurrence of the overshooting. This is because in the substantially fully open position of the throttle valve 8, there is no substantial change in an air flow area of the throttle body 9 even when the valve disc 8*a* is moved to be opened or closed. In addition, the fluctuation in the air amount in the substantially fully open position of the throttle valve 8 may be allowable, because it does not substantially affect traveling capability of the leisure vehicle.

It is known that the proportional gain determines a response speed of the opening and closing operation of the throttle valve in the PID control or the PD control of the throttle valve of the engine. As the proportional gain is set larger, the response speed of the throttle valve increases, but the degree of overshooting increases. The TVC 20 is configured to set an overshooting region to increase the response speed of the throttle valve 8.

Figure 7:
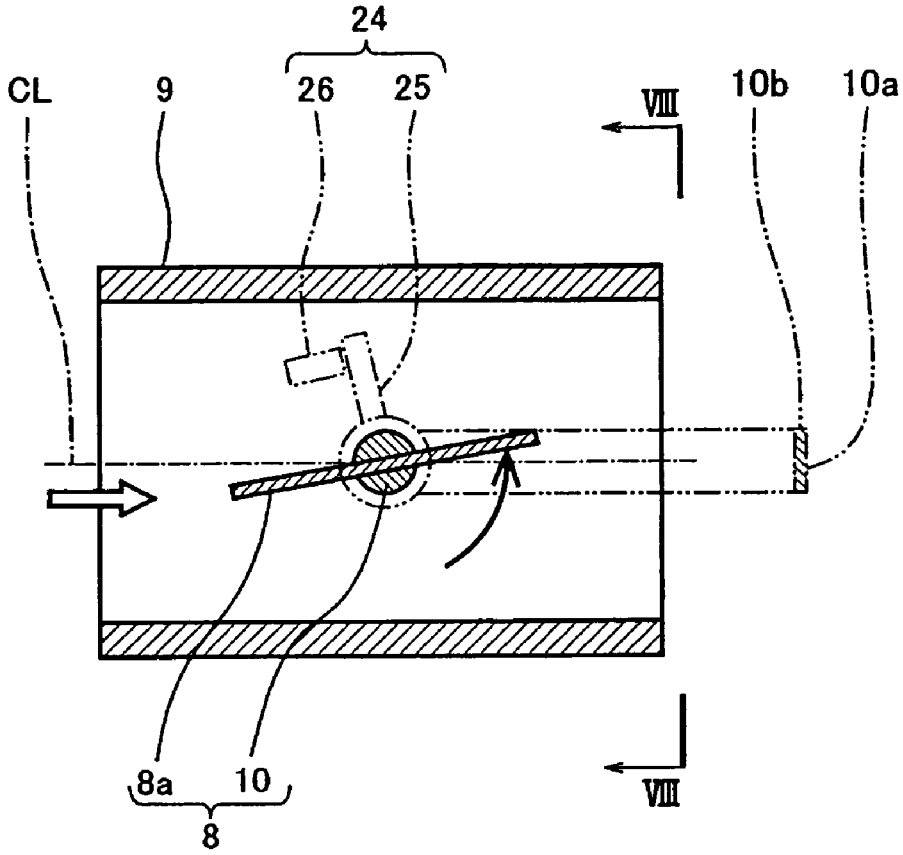
FIG. 7 is a longitudinal sectional view of the throttle valve.
Figure 8:
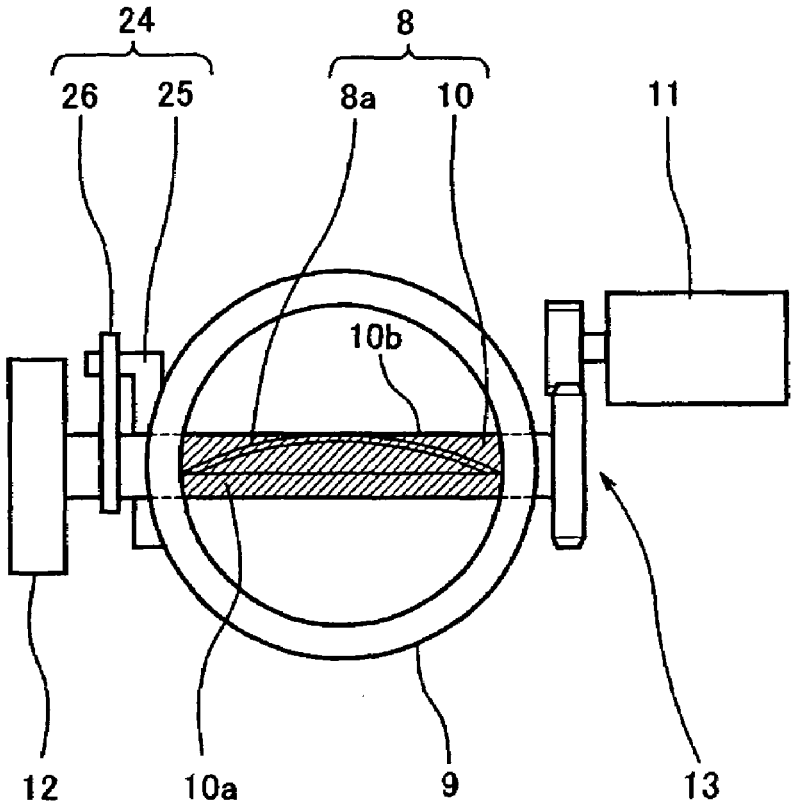
FIG. 8 is a view taken in the direction of arrows along line VIII-VIII of FIG. 7, as viewed in a flow direction of the air taken in from outside.

With reference to FIGS. 7 and 8, a manner of setting the overshooting region will be described. FIG. 7 is a longitudinal sectional view of the throttle valve 8. FIG. 8 is a view taken in the direction of arrows along line VIII-VIII of FIG. 7, as viewed in a flow direction of the air taken in from outside and supplied to the engine 2. In this embodiment, the throttle valve 8 includes the valve shaft 10 and the circular-plate shaped valve disc 8*a* inserted into a slit (not shown) formed in the valve shaft 10 along a center axis of the valve shaft 10. The illustrated structure of the throttle valve 8 is exemplary. Typically, the diameter (or width, thickness, and so on) of the cross-section of the valve shaft 10 is larger than the thickness of the valve disc 8*a*.

As shown in FIG. 7, with the valve disc 8*a* of the throttle valve 8 in the fully open position, i.e., the valve disc 8*a* oriented in a direction along the center axis CL of the air flow passage of the throttle body 9, the air flow passage cross-sectional area of the throttle body 9 is smaller than the area formed inside the throttle body 9, by the area of a projected image 10*a* of the valve shaft 10 that is formed as viewed in the direction of the center axis CL. Therefore, even when a tip end of the valve disc 8*a* is displaced to be opened or be closed within a range of the projected image 10*a* from the fully open position, the air flow passage area of the throttle body 9 does not substantially change. In view of this, by setting the upper limit of the overshooting region to a position where the tip end of the valve disc 8*a* substantially conforms to an outer periphery 10*b* of the projected image 10*a* formed when the valve disc 8*a* is displaced in an opening direction, substantial fluctuation in the amount of air taken in which may be caused by the overshooting can be avoided. In a transfer function in the control executed by the TVC 20, proportional terms, derivative terms, etc., which cause such overshooting to occur, are set.

Since the slight fluctuation in the output in the high engine speed range does not substantially affect the traveling capability of leisure vehicles such as a motorcycle as described above, the upper limit of the overshooting may be set in a position farther displaced in the opening direction from the outer periphery 10*b* of the projected image 10*a* of the valve shaft 10. For example, the overshooting region may be set to 8 to 12% of the opening degree of the throttle valve 8. The reason for this is that the value "8%" substantially corresponds to the outer periphery 10*b* of the projected image 10*a* of the valve shaft 10, and the fluctuation in the amount of air taken in may be greater when the overshooting exceeds 12%. The symbol "%" is herein used to indicate a ratio of a valve angle that is represented by percentage when the rotational angle of the valve disc 8*a* from the fully closed position to the fully open position is 100%. For example, if the fully open position is the rotational angle of 87 degrees of the valve disc 8*a*, then 10% of the overshooting region is 8.7 degrees.

In the case where the target opening degree of the throttle valve 8 according to the operation of the accelerator grip 17 abruptly changes in a step shape to the fully open position, the TVC 20 controls the DC motor 11 based on a deviation (deviation between the target opening degree and the actual opening degree) so as to generate a predetermined overshooting amount, for example, 11% of the fully opening degree with respect to the target valve opening degree. To be specific, the DC motor 11 is controlled to achieve precise responsiveness to the target opening degree when the throttle valve 8 is quickly moved to the fully open position, so that the throttle valve 8 opens beyond the fully open position, i.e., overshoots. The control coefficient that mainly determines the responsiveness is a gain. The gain may be made different between a fully open position range where the amount of air taken in from outside changes less with respect to the change in the valve opening degree and a slight open position range where the amount of air changes significantly with respect to the change in the valve opening degree. To be specific, a smaller gain is set from the slight opening position range so that the overshooting with respect to the target opening degree of the throttle valve is inhibited in the slight open position range. In contrast, by increasing the overshooting amount with respect to the fully open position, the responsiveness of the throttle valve 8 is improved.

As used herein, the term "fully open position range" refers to approximately 80 to 100% opening degree range, and the term "slight open position range" refers to approximately 0 to 30% opening degree range.

As shown in FIGS. 7 and 8, the electronic control throttle system 1 may be equipped with a mechanical stopper 24 of the throttle valve 8. The mechanical stopper 24 includes a stopper arm 25 and a stopper contact member 26 which the stopper arm 25 is configured to contact. The stopper arm 25 is secured to the valve shaft 10 of the throttle valve 8. The stopper contact member 26 is secured to the throttle body 9. The stopper arm 25 contacts the stopper contact member 26, thereby inhibiting further rotation in the opening direction of the throttle valve 8.

The stopper contact member 26 is positioned so that the stopper arm 25 contacts the stopper contact member 26 when the valve disc 8*a* slightly rotates in the opening direction in the overshooting region set for the throttle valve 8. To position the stopper contact member 26, at least one of the stopper arm 25 and the stopper contact member 26 is mounted to be position-adjustable. With such a configuration, the TVC 20 sets the overshooting region, and the stopper arm 25 and the stopper contact member 26 are adjustably positioned to correspond to the overshooting region. The mechanical stopper 24 makes it possible to inhibit the throttle valve 8 from exceeding the set upper limit.

Whereas the throttle valve 8 is a butterfly valve in the above described embodiment, it may alternatively be a slidable throttle valve. Unlike the butterfly valve, the slidable throttle valve does not have a feature that the opening degree fluctuation in a range of a projected image of a valve shaft thereof does not substantially affect the amount of air taken in from outside and supplied to the engine. However, in the slidable throttle valve, also, slight fluctuation in the output in the substantially open position of the throttle valve does not significantly affect the traveling capability of the leisure vehicle. Therefore, the slidable throttle valve may be applied to the electronic control throttle system capable of positively setting the overshooting region exceeding the fully open position.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A leisure vehicle comprising:

an electronic control throttle system of an engine in which an actuator drives a throttle valve of the engine in response to an operation signal according to an operation amount of a throttle operation device of the vehicle, the electronic control throttle system including:

a throttle valve controller configured to send a control signal to the actuator to drive the throttle valve;

wherein the throttle valve controller is configured to give a gain to compensate for a deviation between a target opening degree of the throttle valve that is set based on the operation amount of the throttle operation device and an actual opening degree of the throttle valve which is a detected opening degree of the throttle valve; and wherein the throttle valve controller is configured to set the gain that causes the throttle valve to enter an overshooting region that exceeds a fully open position in a movement range of the throttle valve.

2. The leisure vehicle according to claim 1, wherein the throttle valve is a butterfly valve including a rotatable valve shaft and a valve disc attached to the rotatable valve shaft; and wherein a projected image of the valve disc at an upper limit of the overshooting region that is formed as viewed from a center axis direction of an air flow passage of the throttle valve falls within a projected image of the valve shaft that is formed as viewed from the center axis direction.

3. The leisure vehicle according to claim 1, wherein the throttle valve is a butterfly valve, and the upper limit of the overshooting region of the throttle valve is set in an open position obtained by rotating the throttle valve from the fully open position to a position that is open to an 8% to 12% opening degree of the fully open position.

4. The leisure vehicle according to claim 3, wherein the electronic control throttle system further includes a mechanical stopper that is disposed at a location of the movement range of the throttle valve to inhibit the throttle valve from being moved in an opening direction beyond the upper limit of the overshooting region.

5. The leisure vehicle according to claim 1, wherein the electronic control throttle system is configured to set gains which are different between a slight opening degree range of the throttle valve and an opening degree range of the throttle valve that is larger than the slight opening degree range.

* * * * *